US008739445B2

(12) United States Patent
Burke et al.

(10) Patent No.: US 8,739,445 B2
(45) Date of Patent: Jun. 3, 2014

(54) CALIBER CONVERSION FOR PISTOL

(75) Inventors: Sean R. Burke, Boise, ID (US); Eric G. Jeppesen, Boise, ID (US)

(73) Assignee: Technical Solutions, Inc., Boise, ID (US)

( * ) Notice: Subject to any disclaimer, the term of this patent is extended or adjusted under 35 U.S.C. 154(b) by 144 days.

(21) Appl. No.: 13/342,970

(22) Filed: Jan. 3, 2012
(Under 37 CFR 1.47)

(65) Prior Publication Data

US 2012/0317856 A1 Dec. 20, 2012

Related U.S. Application Data

(60) Provisional application No. 61/429,018, filed on Dec. 31, 2010.

(51) Int. Cl.
*F41A 17/64* (2006.01)
*F41A 21/00* (2006.01)

(52) U.S. Cl.
USPC ..... 42/16; 42/25; 89/29

(58) Field of Classification Search
USPC ..... 42/70.02, 70.01, 16, 25; 89/29
See application file for complete search history.

(56) References Cited

U.S. PATENT DOCUMENTS 3,771,415 A * 11/1973 Into et al. ..... 89/16
4,031,648 A * 6/1977 Thomas ..... 42/70.02
4,352,317 A * 10/1982 Wilhelm ..... 89/154
4,589,327 A * 5/1986 Smith ..... 89/148
4,974,356 A * 12/1990 Kelsey et al. ..... 42/69.03
5,216,191 A * 6/1993 Fox ..... 42/70.05
5,614,691 A * 3/1997 Taylor ..... 89/128
6,571,501 B1 6/2003 Jennings
6,625,916 B1 * 9/2003 Dionne ..... 42/16
7,243,453 B2 * 7/2007 McGarry ..... 42/70.08
7,631,453 B2 * 12/2009 Longueira ..... 42/16
8,429,844 B2 * 4/2013 Dextraze et al. ..... 42/73
8,522,465 B2 * 9/2013 Jarboe et al. ..... 42/16
2009/0151213 A1 * 6/2009 Bell ..... 42/69.03
2010/0307042 A1 * 12/2010 Jarboe et al. ..... 42/6
2012/0159828 A1 * 6/2012 Jarboe et al. ..... 42/16
2012/0180354 A1 * 7/2012 Sullivan et al. ..... 42/16
2013/0326924 A1 * 12/2013 Jarboe et al. ..... 42/17

OTHER PUBLICATIONS

Advantage Arms inc. .22 Caliber Conversion Kit for the Glock Pistol Patented, product brochure, date not available, Valencia, CA.
Jonathan Arthur Ciener Inc., The "Ciener" Glock 17/22 & 19/23 .22LR Conversion Units, http://www.22Irconversions.com/glk-pg.htm, Oct. 7, 2010.

* cited by examiner

*Primary Examiner* — Michael David
(74) *Attorney, Agent, or Firm* — Pedersen and Company, PLLC; Ken J. Pedersen; Barbara S. Pedersen

(57) ABSTRACT

A robust and convenient caliber conversion kit is described, for example, for the higher-caliber GLOCK® semi-automatic pistol. The caliber conversion kit has an internalized spent round extractor for more reliability. In addition, the firing pin safety relies on a set of two-dimensional surfaces, rather than on a one-dimensional line or edge, for cooperation (interaction and support) with the firing pin and with a recess in the firing pin housing that receives the safety, resulting in more security. Also, the spent round ejector is snugly fastened around an outwardly-extending abutment of steel on the barrel, the abutment being within a recess also snugly fitting the perimeter of the front end of the ejector, resulting in a quieter ejector mechanism.

1 Claim, 10 Drawing Sheets

CALIBER CONVERSION FOR PISTOL

This application claims benefit of U.S. Provisional Application Ser. No. 61/429,018, filed Dec. 31, 2010, the entire disclosure of which is incorporated herein by this reference.

BACKGROUND OF THE INVENTION

1. Field of the Invention

This invention relates generally to the field of firearms wherein the caliber of a firearm is desired to be changed. For example, a higher-caliber pistol with a slide and barrel assembly may be adapted to shoot lower-caliber ammunition by replacement of the slide and barrel assembly. This way, for example, a typically lower-priced, lower-caliber ammunition may be substituted for the higher-priced, higher-caliber ammunition for shooting practice purposes.

2. Related Art

U.S. Pat. No. 6,571,501 (Jennings) discloses a semi-automatic pistol caliber conversion kit wherein the slide and barrel assembly for a lower-caliber ammunition is substituted for a higher-caliber ammunition slide and barrel. In Jennings, the substitute slide housing is composed of aluminum, and a steel insert is secured to the substitute aluminum slide housing to reinforce the point on the slide where the substantial additional forces of the "last round left open" latch feature of the pistol are applied. In addition, the barrel of the pistol in Jennings is of steel, so that the barrel may be artfully and carefully machined to maintain strength and still reduce weight, again in the crucial "last round left open" latch feature region of the pistol.

SUMMARY OF THE INVENTION

The present invention is a robust and convenient caliber conversion kit for, for example, the GLOCK® (a registered U.S. trademark of Glock Inc.) semi-automatic pistol in 9 mm and .40 and .45 calibers. Preferably, the kit converts these calibers to .22 caliber. The present invention has an internalized spent round extractor system for more reliability and efficiency, compared to other conversion kits. In addition, the firing pin safety system of the present invention is easily removable and interacts with a set of two-dimensional surfaces, rather than with only a one-dimensional line or edge. Subsequently, the safety mechanism of the present invention is less vulnerable to wear and more secure. Also, according to the present invention, the spent round ejector is securely soldered or fastened otherwise around an outwardly-extending abutment of steel within a recess on a side of the barrel that securely fits around all sides of the ejector, resulting in a quieter, stronger and longer lasting ejector mechanism.

DETAILED DESCRIPTION OF THE INVENTION

Referring to the Figures, there is shown one, but not the only, embodiment of the invented caliber conversion kit for a pistol.

Figure 1:
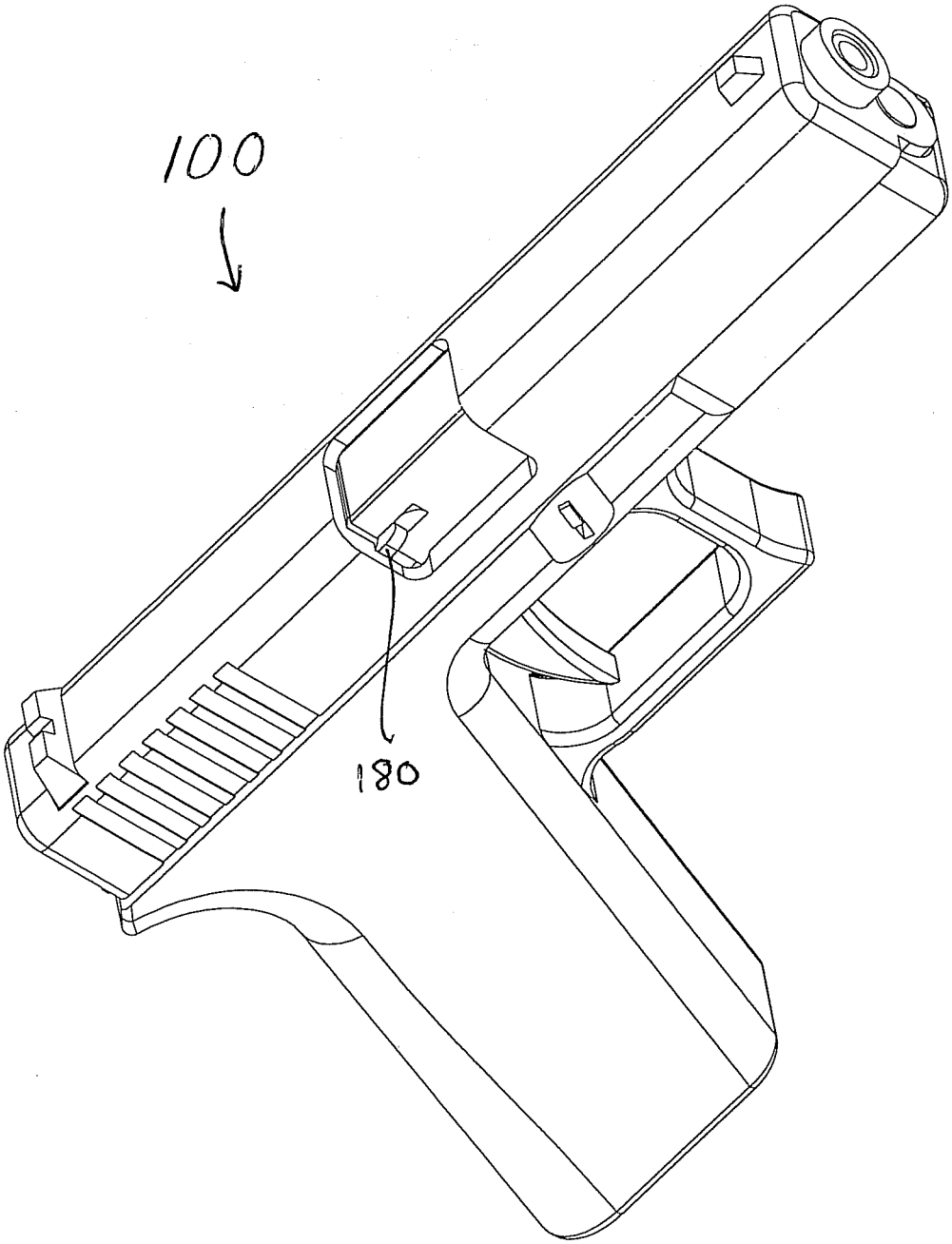
FIG. 1 is a top, side perspective view of one embodiment of the caliber conversion kit of the present invention on a GLOCK® pistol with the slide assembly fully extended.
Figure 2:
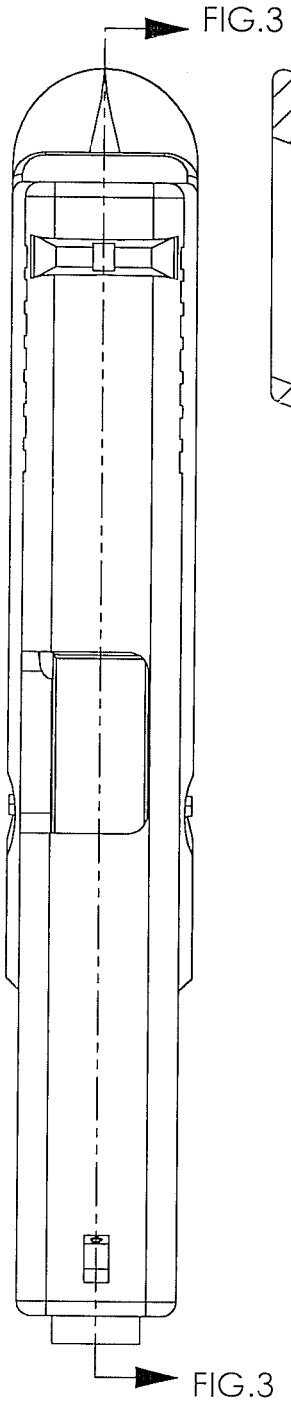
FIG. 2 is a top view of the view depicted in FIG. 1.
Figure 5:
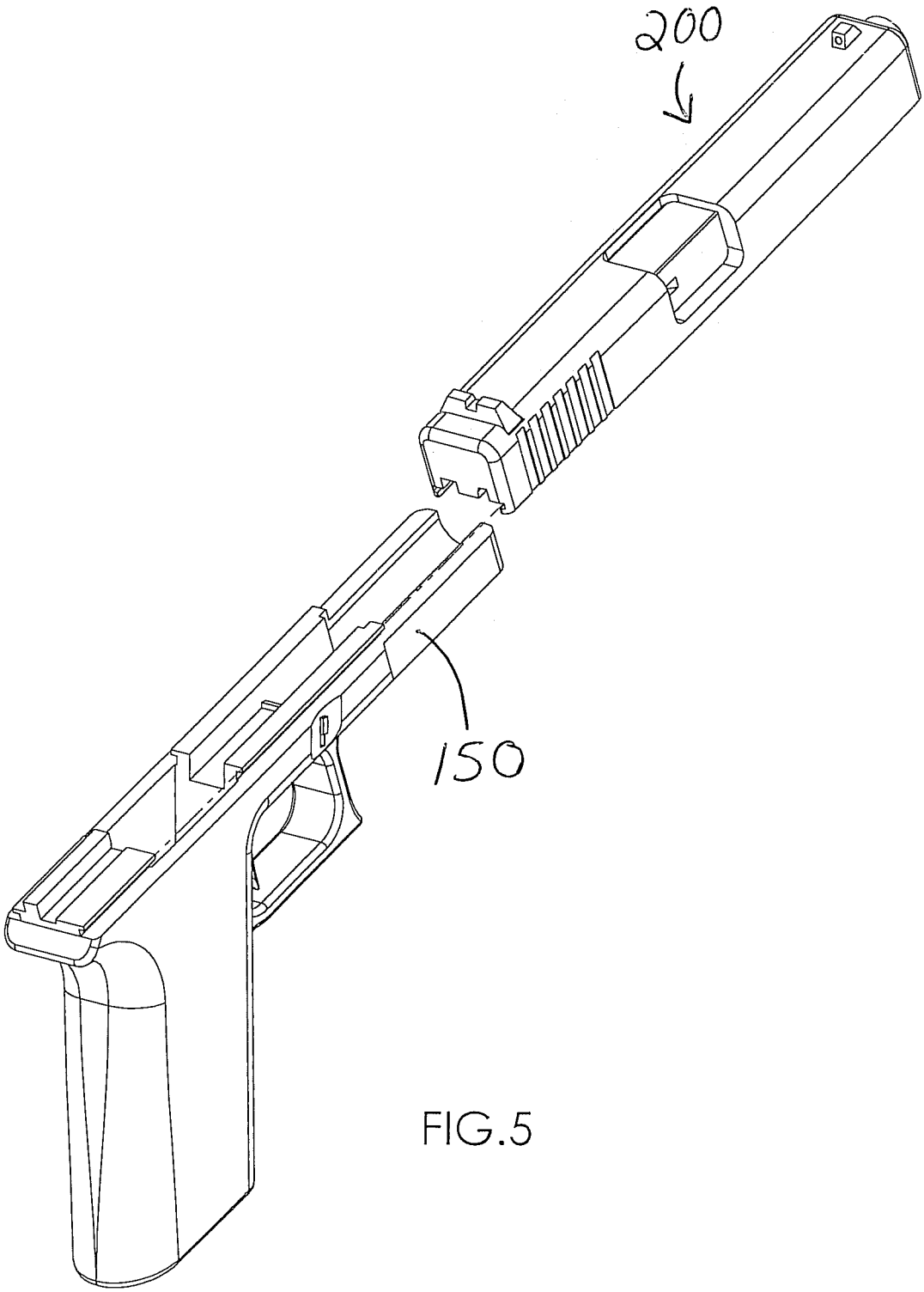
FIG. 5 is a top, partially exploded perspective view of how the top, caliber conversion kit assembly fits onto the bottom of the pistol.
Figure 6:
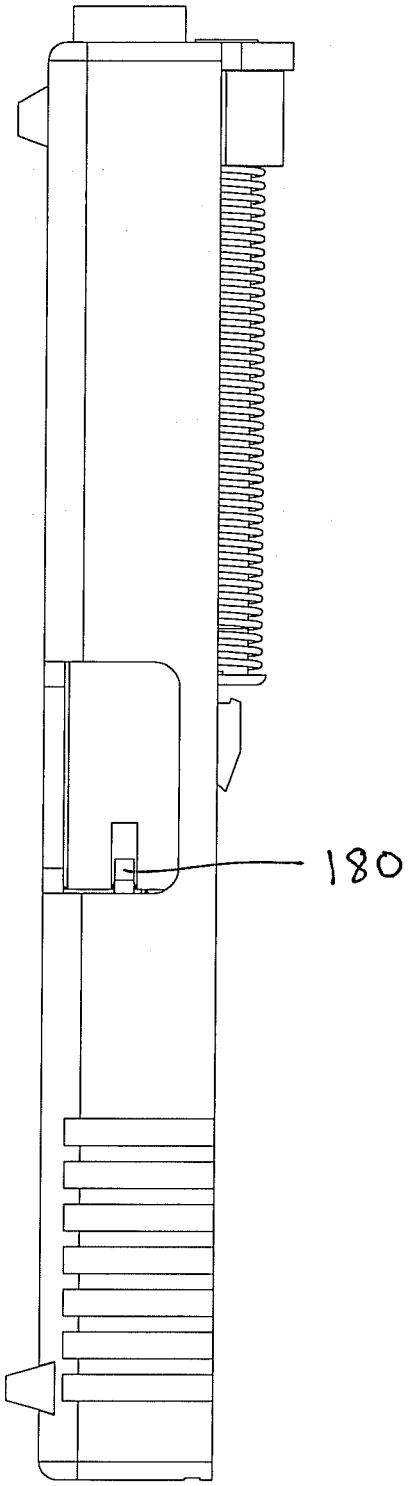
FIGS. 6 through 12 are views of the caliber conversion kit in various orientations to show details of the construction of this assembly.
Figure 7:
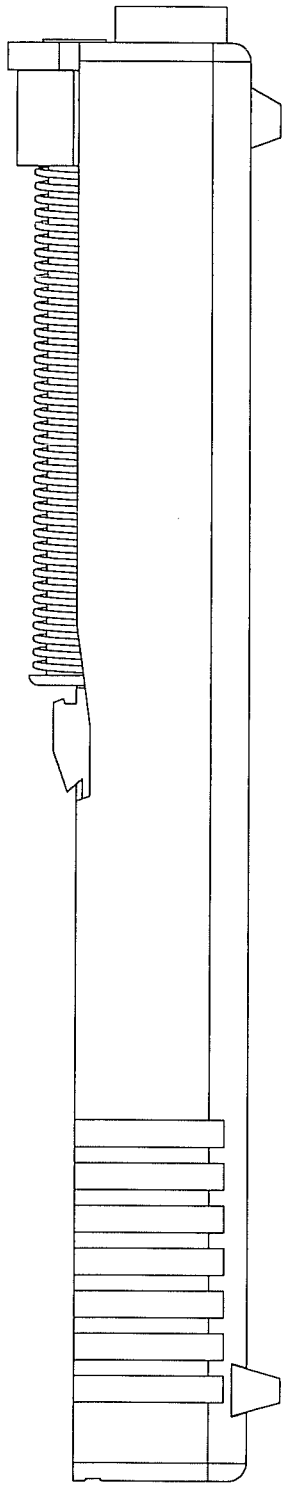
Figure 8:
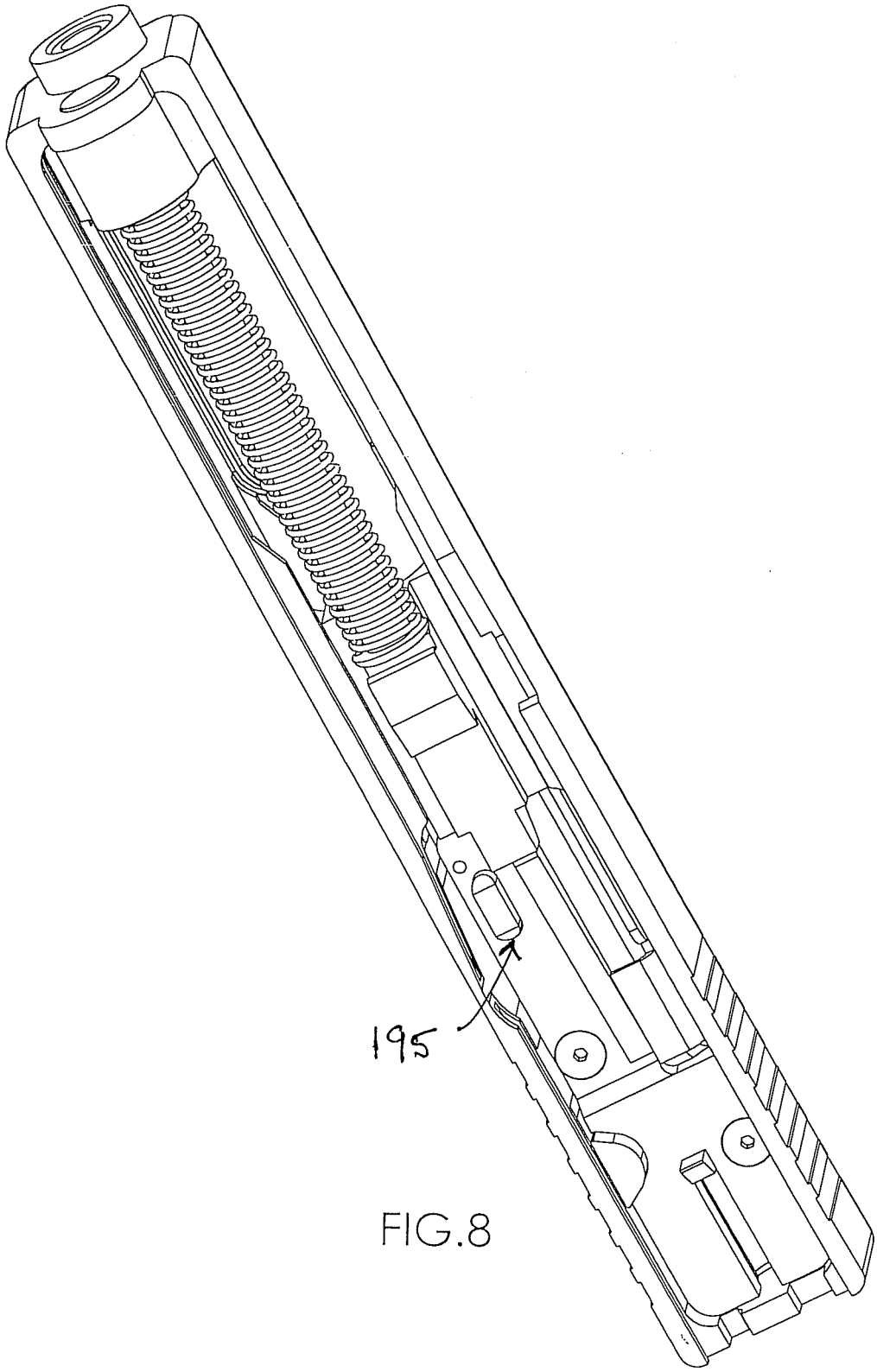
Figure 9:
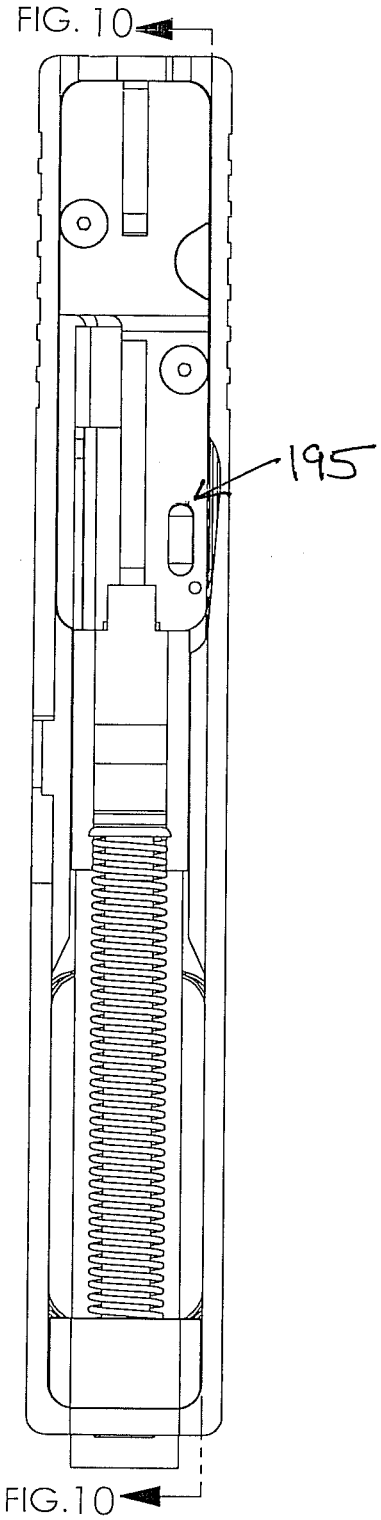
Figure 10:
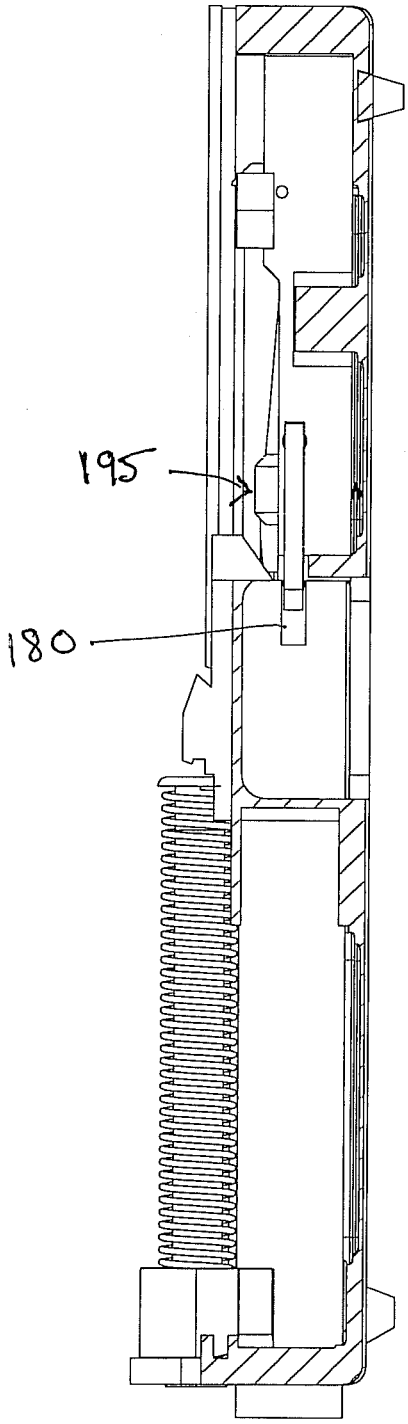
Figure 11:
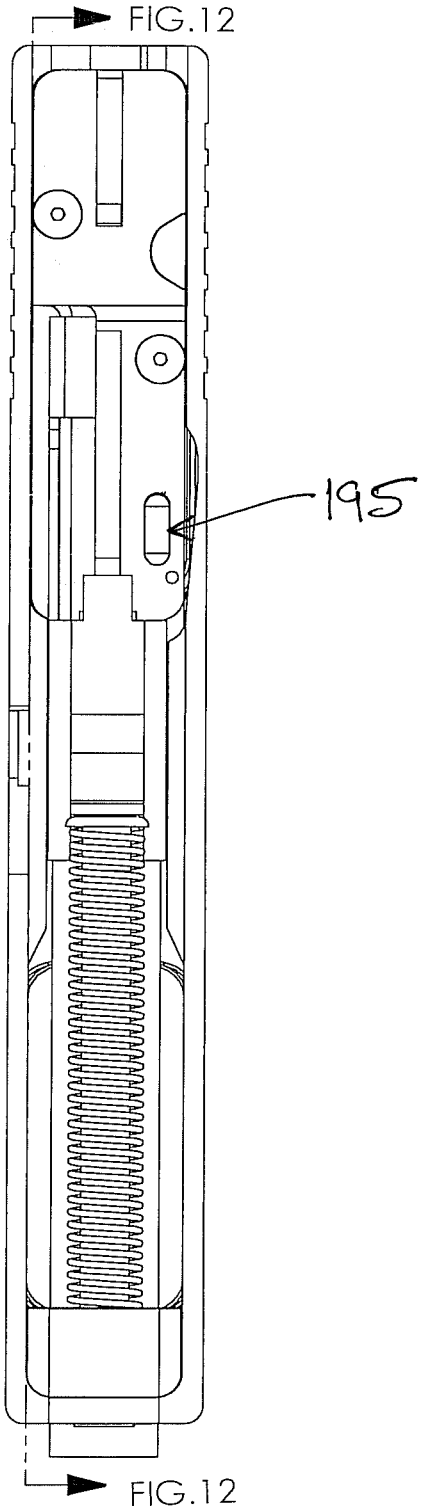

The key conceptual Figures are No. 1, No. 5, No. 13 and No. 14. In FIG. 1 is depicted a semi-automatic pistol 100. At the gunman's choice, the caliber conversion slide and barrel assembly according to the invention may be installed as depicted as item 200 in FIG. 5. This way, for example, smaller-caliber, less expensive ammunition may be used in the pistol for practice. The conversion kit of the present invention may also serve for other purposes of the gunman. For example, a caliber change may be made with the subject kit to accommodate different ammunition for a different distance or type of target or type of environment for use, and not for economy. Also, a desired different conversion slide and barrel assembly may be installed to accommodate different shape or styled ammunition of even the same caliber.

When the original bottom half of pistol 150 is slid under and secured to the replacement top half 200, the slide and barrel assembly, all operative connections between the two parts of the gun must function properly. This requires that all the original connections in the top and bottom halves of the gun be maintained. These operative connections are maintained by the conversion slide and barrel assembly being built to accommodate the mechanical structure of the bottom half of pistol 150. In this regard, the inventors of the subject kit have followed the conventional approach as depicted, for example, in the Jennings '501 patent discussed above.

Figure 3:
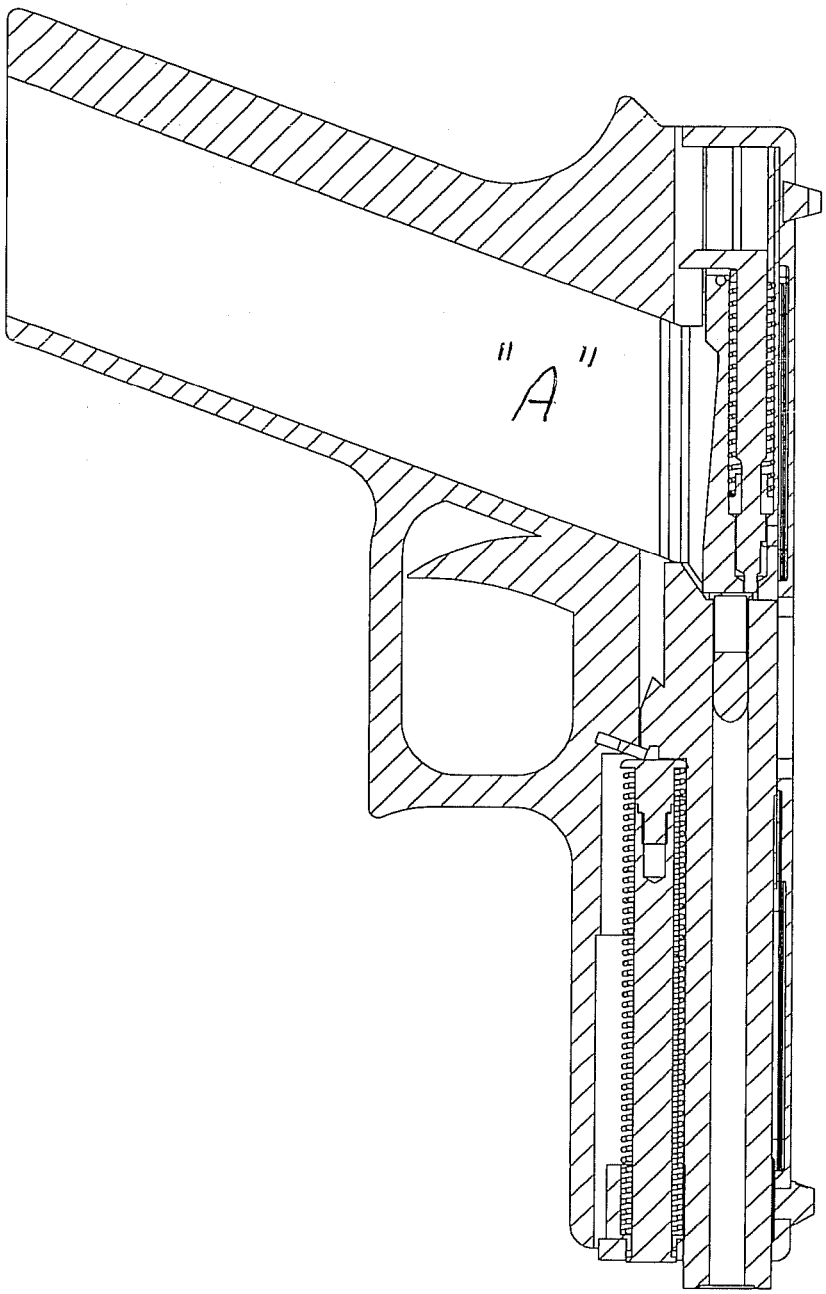
FIG. 3 is a side, cross-sectional view along the lines 3-3 of the view depicted in FIG. 2.
Figure 4:
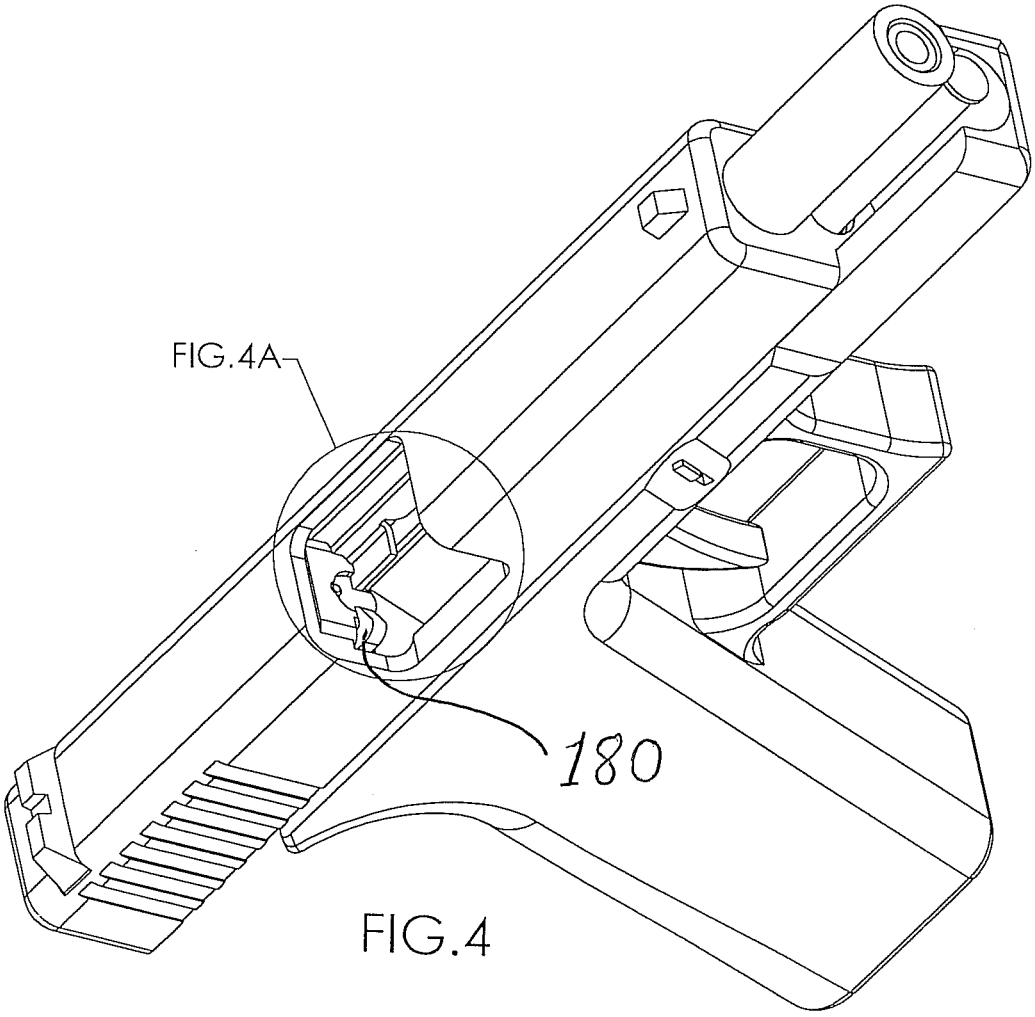
FIG. 4 is a top, side perspective view of one embodiment of the caliber conversion kit of the present invention on a GLOCK® pistol with the slide assembly fully retracted.
Figure 4A:
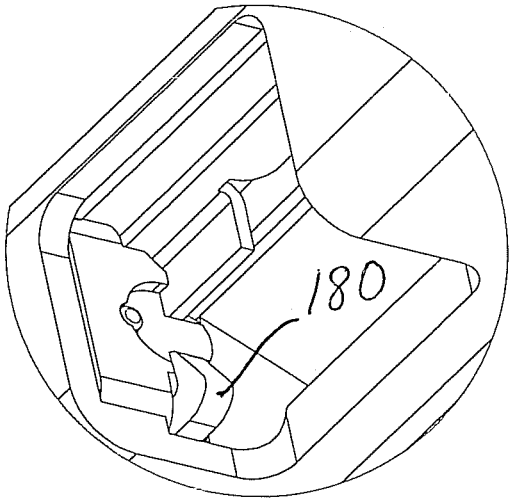
FIG. 4A is a top, detail perspective view of the circled area in FIG. 4, showing the open ejector port for ejecting spent rounds from the pistol.

So, all the necessary operative connections between the bottom half 150 of the larger-caliber pistol and the top half 200 of the smaller-caliber conversion kit have been maintained so that, when a smaller-caliber magazine is inserted generally at location "A" in FIG. 3, the caliber conversion kit will safely fire repeatedly, and cycle in the semi-automatic mode to extract and expel spent rounds from the breech, and then load a fresh round again effectively from the magazine for further firing.

The views of the upper slide and barrel assembly of FIGS. 6-12 reflect this capability of compatibility from design and engineering. In addition, these and other Figures depict some specific improvements of the subject kit.

I. Internalized Spent Round Extractor System.

The internalized extractor 180 is depicted in FIGS. 1, 4, 4A, 6, 10, 13, and 14. There, it may be seen that the outside rounded curve of the extractor 180 is directed inwardly, towards the center of, and backwardly from, the ejector port of the pistol. Also, the inside curve of the ejector near its tip is substantially radial and straight, and meets the outside curve at a sharp line. This way, the ability of the extractor to grab, for example, the rimfire casing of the spent 22 round, is increased, due to less interference by shock, wobble and shake from recoil, etc. during operation of the pistol. This feature of the subject caliber conversion kit results in more reliability and efficiency for handling spent rounds.

II. Stabilized Firing Pin Safety System.

The firing pin safety 195 is depicted in FIGS. 8-14. There, it may be seen that safety 195 is secured in a recess in the firing pin housing, with a spring 196 contact to the inside surface of the top of the slide. This cylindrical coiled spring 196 absorbs shock, wobble and shake for more reliability from less wear. Also, the three dimensional firing pin safety 195 has substantially flat bottom surface 197 and substantially flat front, side, and back surfaces 198, 198', and 198" for interacting, respectively, with the operative surfaces of the firing pin 199 and the inside surfaces of the recess in the firing pin housing which receives safety 195. Therefore, according to the present invention, the firing pin safety interacts with the firing pin 199 and the safety's securement recess with a surface, not just a line or an edge. For example, the firing pin safety interacts with the firing pin 199 and the safety's securement recess with a surface at least 1 mm wide and at least 1 mm long, not just a line or an edge. Also, the firing pin safety may be conveniently removed and replaced when showing signs of wear, a safety improvement. Again, this results in a safer, more secure pistol operation.

III. Securely Fastened Spent Round Ejector.

Figure 12:
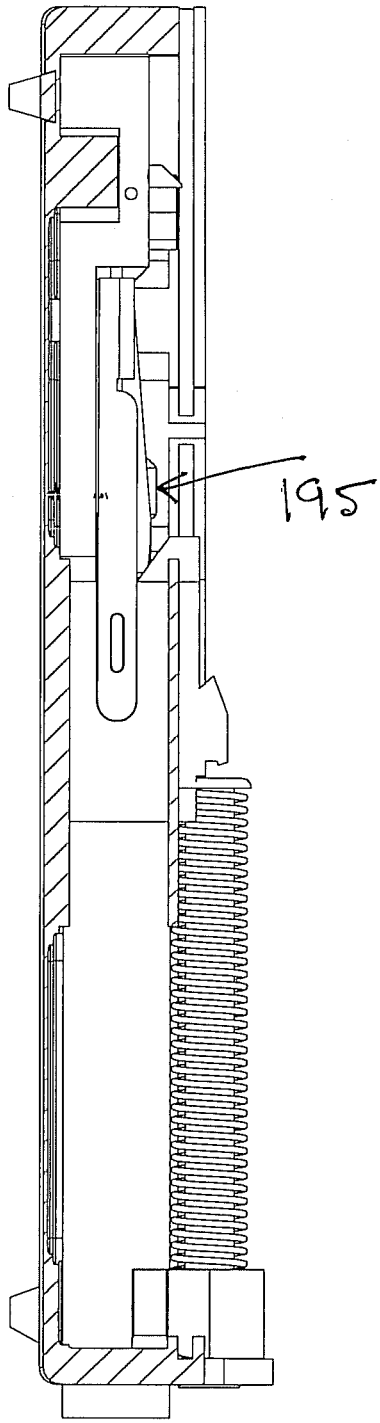
Figure 13:
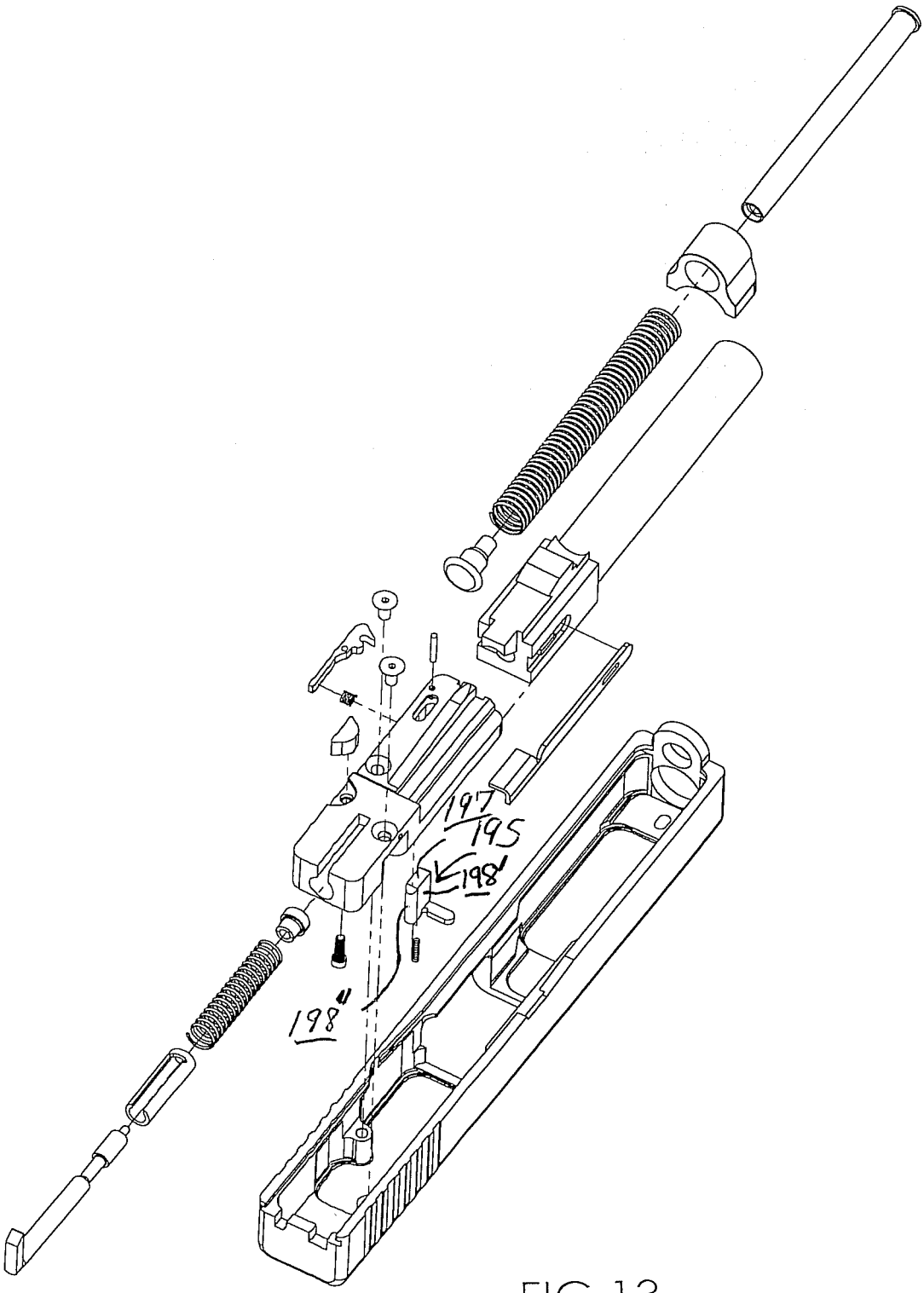
FIG. 13 is a bottom, perspective exploded view of the slide and barrel assembly for the caliber conversion kit of the present invention.
Figure 14:
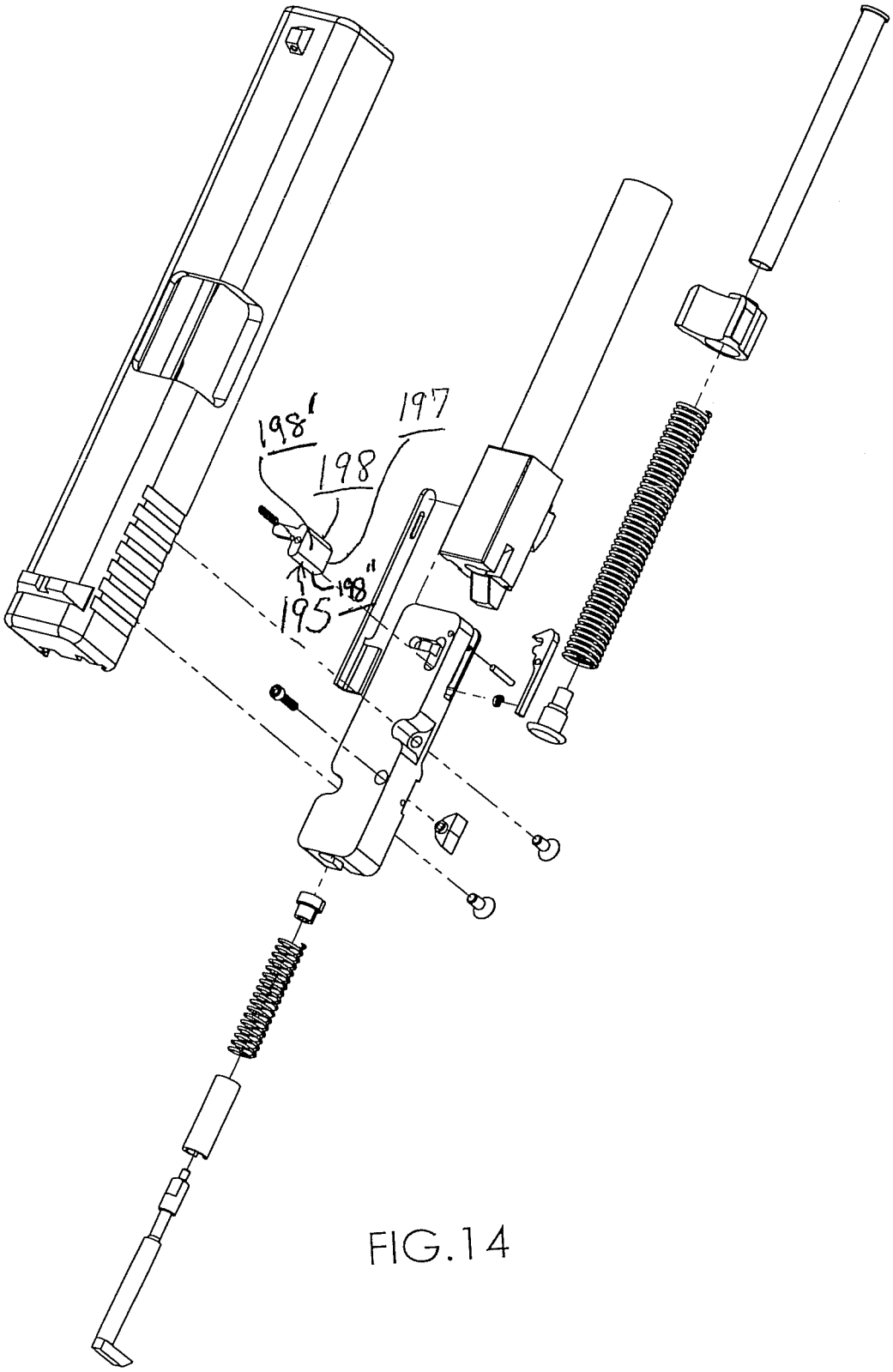
FIG. 14 is a top, perspective exploded view of the slide and barrel assembly for the caliber conversion kit of the present invention.

The spent round ejector 201 is depicted in FIGS. 12-14. There, it may be seen that ejector 201 has a hole near its forward end, the hole being dimensioned to fit snugly around, and be secured to, a cooperating, outwardly extending abutment 202 within recess 203 on the side of the barrel. Furthermore, recess 203 is dimensioned to fit snugly around the side perimeter of forward end of ejector 201. This feature of applicant's caliber conversion kit results in a tight fit and less noise or rattle during operation of the pistol.

Although this invention has been described above with reference to particular means, materials and embodiments, it is to be understood that the invention is not limited to these disclosed particulars, but extends instead to all equivalents within the broad scope of the following claims.

We claim:

1. In a pistol caliber conversion kit comprising a replacement slide and barrel assembly with an ejector port, the improvement comprising a spent round extractor with a forward tip, the tip having an outside rounded curve adapted to be directed inwardly towards the center of, and backwardly from, the ejector port, the extractor also having an inside curve near said tip that is substantially radial and straight and meets the outside curve at a sharp line.

* * * * *